United States Patent [19]

Mason

[11] 4,326,356

[45] Apr. 27, 1982

[54] CARDBOARD FOOD TRAY AND PUPPET DEVICE

[75] Inventor: Thomas A. Mason, Racine, Wis.

[73] Assignee: Western Publishing Company, Inc., Racine, Wis.

[21] Appl. No.: 186,947

[22] Filed: Sep. 15, 1980

[51] Int. Cl.[3] ..... A63H 3/14; A63H 33/00; B65D 5/20

[52] U.S. Cl. ..... 46/154; 229/30; 46/11

[58] Field of Search ..... 46/11, 154, 11 L; 206/815; 229/30, 8; 40/124.1, 124, 124.2, 124.4

[56] References Cited

U.S. PATENT DOCUMENTS

| | | | |
|---|---|---|---|
| 2,127,412 | 8/1938 | Fevre | 46/11 |
| 2,130,343 | 9/1938 | Havel | 46/13 |
| 2,392,991 | 1/1946 | Macomber | 46/154 |
| 2,571,744 | 10/1951 | Midouhas | 46/11 |
| 2,620,591 | 12/1952 | Scola | 46/13 |
| 2,621,440 | 12/1952 | Stone | 46/13 |
| 2,640,589 | 6/1953 | Foster et al. | 229/30 |
| 2,709,319 | 5/1955 | Balton | 46/154 |
| 2,819,559 | 1/1958 | Daley | 46/123 |
| 3,044,211 | 7/1962 | Palm | 46/11 |
| 3,440,747 | 4/1969 | Oliver | 46/11 |
| 3,442,043 | 5/1969 | Panzer | 46/11 |
| 3,747,264 | 7/1973 | Brandwein | 46/154 |
| 3,778,925 | 12/1973 | Owen | 46/13 |
| 3,848,356 | 11/1974 | Wylre et al. | 46/11 |

*Primary Examiner*—Gene Mancene
*Assistant Examiner*—Michael J. Foycik
*Attorney, Agent, or Firm*—Ronald M. Goldman; Max E. Shirk; Roy A. Ekstrand

[57] ABSTRACT

A generally rectangular sheet of self-supporting material such as paperboard is scored and cut in such a manner as to be foldable into a fast food carry-out tray which can be converted after use by manipulation of preformed tear and fold lines into a hand puppet. The fast food carry-out tray has at least one opening extending into a tray cavity for receiving a paper cup or food item. In a preferred embodiment, the tray is also provided with a box-like cover. The sheet material is printed with designs or indicia which suggest a hand puppet character. Cut-out tabs may also be provided for insertion into the sheet material to further create an impression of eyes, a nose, or the like of a hand puppet character.

4 Claims, 3 Drawing Figures

CARDBOARD FOOD TRAY AND PUPPET DEVICE

BACKGROUND OF THE INVENTION

1. Field of the Invention

The present invention relates to sheet material articles and more particularly to a sheet of material formed into a fast food carry-out tray which may be converted after use into a hand puppet.

2. Description of the Prior Art

Panzer, in U.S. Pat. No. 3,442,043, issued May 6, 1969, discloses a paper bag puppet which folds flat and has printed decorations thereon. The bag is provided with conventional creases to allow the bag to fold flat. The puppeteer inserts his hand into the bag with his fingers between the upper edge and the crease and his thumb below the crease to form a curve from the crease to the front face of the bag.

Macomber, in U.S. Pat. No. 2,392,991, issued Jan. 15, 1946, discloses a paper match book comprising opposing rows of match heads and which can be folded to provide a central mouth opening.

Wylie et al., in U.S. Pat. No. 3,848,356, issued Nov. 14, 1946, disclose an envelope of paper card stock useful in one configuration for holding french fries or the like and, in another configuration, as a puppet. Triangular side panels along the bottom crease are turned inside out from the envelope configuration to form inner mouth surfaces for an animal head puppet.

It is an object of the present invention to provide a fast food carry-out tray which can be easily converted by a consumer into a hand puppet.

It is a further object of the present invention to provide a fast food carry-out tray which is convertible into a hand puppet and is formed from a single piece of cardboard or other sheet material.

It is a further object of the present invention to provide an inexpensive hand toy in which play value is added at little cost through the use of printed indicia and cardboard cut-outs which may be inserted into the toy.

SUMMARY OF THE INVENTION

These and other objects are attained by a one piece, folded paper sheet carrying tray having a top panel and a bottom panel defining a tray cavity; at least one opening in the top panel for receiving a food item to be carried; a hinge line across the top panel; and a tear line, colinear with a hinge line, extending around the carrying tray so that the tear line may be easily separated by the consumer and the hinge line folded so that the tray may be folded in two and the tray cavity thereby forms hand receiving openings on either side of the hinge line to receive the fingers and thumb, respectively, of a puppeteer.

The one-piece folded sheet carrying tray is formed from a generally rectangular sheet of self-supporting, foldable material comprising a plurality of fold lines, cut lines, and tear lines, including: a first pair of parallel fold lines extending along a length of the sheet material to form a first tray side portion flanked by a top panel and a bottom panel; a second tray side portion, adjacent an edge of the sheet material, cooperating with a first tray side portion in the folded condition to hold in spaced apart relationship the top panel and the bottom panel to form a tray cavity, cut lines in the top panel which provide openings in the tray to receive a paper cup, or a food item, or other article to be carried; a hinge line across the top panel substantially bisecting the top panel; and a tear line, colinear with the hinge line and extending from the hinge line to opposite edges of the sheet material, so that, while the sheet material is folded into a carrying tray after use, a consumer may cut the tear line by hand and readily fold the tray along the hinge line to provide a hand opening on each side of the folded hinge line so that fingers and a thumb may be inserted into the tray on either side of the hinge line, allowing the article to be manipulated as a hand puppet.

Added play value is added to the article with minimal additional cost. The sheet material is printed with an animal, creature, or other design to further enhance the puppet appearance. Slot portions are provided in the sheet material to receive decorative elements such as cardboard cut-out ears, to further create an impression of a hand puppet character. Cut lines may further be provided so that an integral portion of the sheet material may be folded into a stand up position to resemble ears, eyes, teeth, or the like to further enhance the image of a puppet.

The invention further contemplates the incorporation into the sheet material of tabs and slots for easy folding of the sheet material into the carrying tray design, and the provision of a covering element for the tray which may be used as stock material for cut-out decorative elements.

DESCRIPTION OF THE PREFERRED EMBODIMENT

Figure 1:
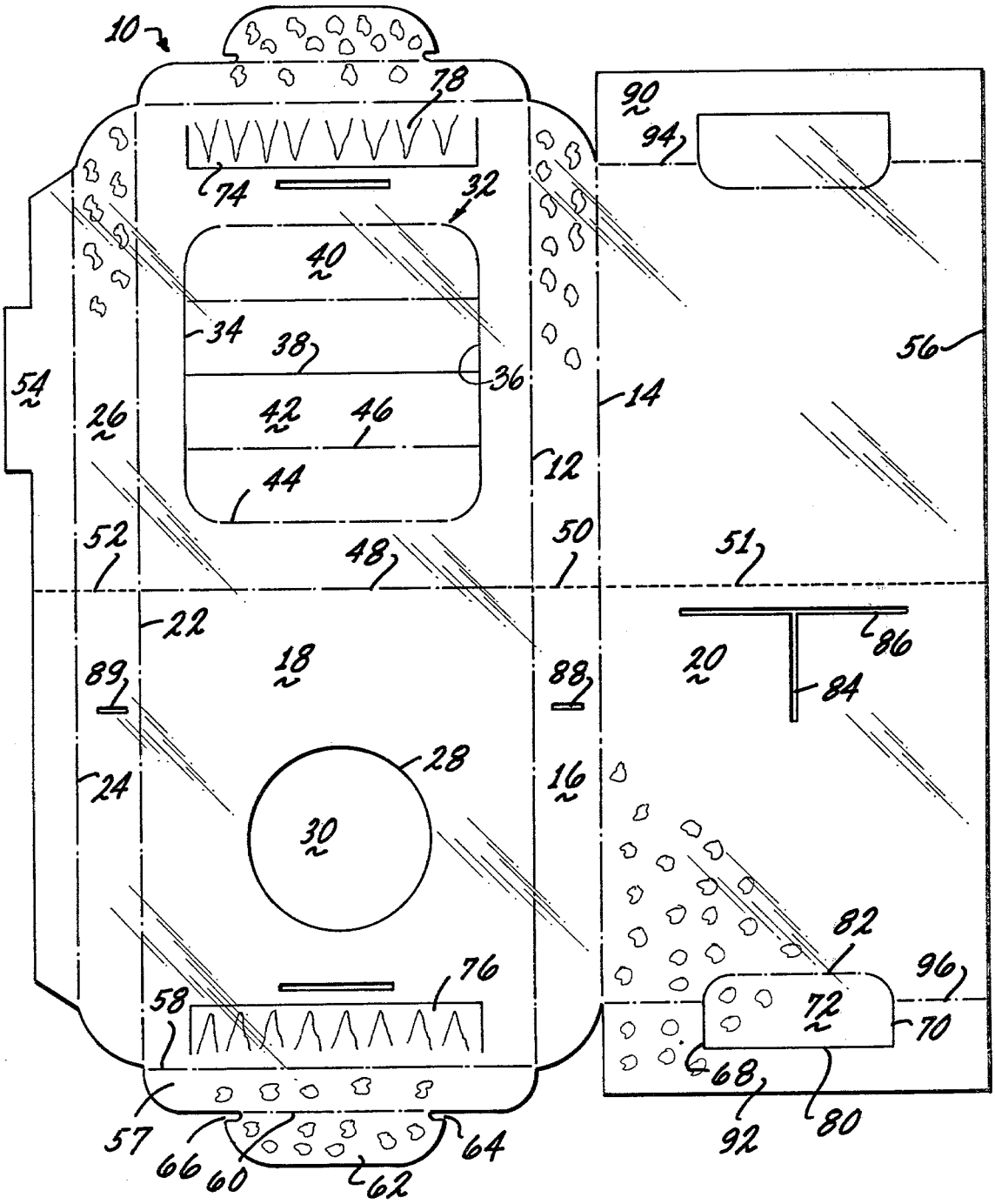
FIG. 1 is a plan view of an unfolded sheet of material notched, scored, and cut, according to the present invention.

Refer now to FIG. 1, the present article may be seen to be formed from a single sheet of self-supporting, foldable material, preferably die cut from a continuous web as is known in the art. The preferred paper material is folding paperboard stock. The sheet material for use in the present invention may be folded and refolded without damage, creased to provide a permanent angle, and scored or intermittently perforated to provide weakened areas for tear lines.

As shown in FIG. 1, a blank 10 cut from sheet material according to the present invention is in the form of a flat, generally rectangular sheet provided with a number of cut lines, and score lines. The blank 10 is divided by a first pair of parallel fold lines 12, 14 formed by cut scoring, into a first side portion 16 between the parallel fold lines, a top panel 18 to the left (in FIG. 1) of the fold lines, and a bottom panel 20 to the right of the fold lines. The top panel 18 extends from the fold line 12 to a second pair of parallel fold lines 22, 24 defining between them a second side portion 26 oppositely symmetrical with the side portion 16. The side portions serve to space the top panel 18 from the bottom panel 20 and are fit to existing tooling to be, typically, about one-inch in width.

The top panel 18 comprises a plurality of cut lines to receive articles such as food items to be held in the folded carrying tray. A circular cut line 28 defines an aperture 30 in the sheet material for receiving a paper cup. A rectangular opening 32 is provided for receiving a hamburger or the like and comprises parallel cut lines 34, 36 parallel to and closely spaced from fold lines 22, 12, respectively, and a cut-line 38 normal to and between lines 34, 36 to define openable flaps 40, 42 each having intermittently perforated folding lines 44, 46 so that the flaps may be readily folded in to receive a food item.

The top panel 18 further comprises a hinge line 48 extending perpendicularly to the parallel fold lines 12, 14, 24, 22 between the aperture 30 and an article receiving cavity 32, and approximately bisecting the top panel. The hinge line 48 is crease scored into the top panel to provide a long living hinge without loss of strength. The hinge line maintains the top panel in a rigidly planar shape until broken by bending the panel, at which time the panel freely bends along the hinge line. A tear line 50, 51 colinear with and continuous with the hinge line 48, extends therefrom from the fold line 12 across the first side portion 16 and the bottom panel 20 to the edge of the blank 10. A similar tear line 52 is continuous with and colinear with the hinge line 48 and extends from the opposite end from the fold line 22 across the second side portion 26 and across a side retaining tab 54 to the edge of the blank 10. The tear lines 50, 52 are formed by closely spaced intermediate perforations in the sheet material.

The side retaining tab 54 extends from fold line 24 and fits, in the folded condition, under an outer side portion 56 of the bottom panel 20 to support the article in the folded condition. The side retaining tab 54 is provided with glue to secure it to the bottom panel 20.

Each end of the top panel 18 comprises an end wall 57 between the fold line 58, 60 to the outer fold line 60 connecting to an end retaining tab 62 which comprises arcuate hook portions 64, 66 for retaining receipt by corners 68, 70 of the retaining slot 72 in the bottom panel 20.

The top panel 18 further comprises a pair of generally U-shaped cut lines 74, 76 which may be folded upwardly from the surface of the blank 10 in the puppet configuration. The cut lines 74, 76 are printed with indicia 78 so that they resemble teeth.

The bottom panel 20 comprises the above-described retaining slots 72 which provide glueless retaining means for receiving tabs 62 from the top panel to hold the article together in a folded condition. The retaining slot 72 comprise a generally U-shaped cut line connected at opposite ends by fold line 82 so that a flap may be folded clear of the sheet material to provide an opening with corners 68, 70 for retaining receipt of the hooks 64, 66. The bottom panel further comprises slot portions 84, 86 for receipt of decorative elements to create the impression of a puppet character. Additional slot portions 88, 89 are provided in the side walls 16, 26. The bottom panel further comprises end portions 90, 92 defined by fold lines 94, 96 to form endwall portions of the folded article.

Figure 2:
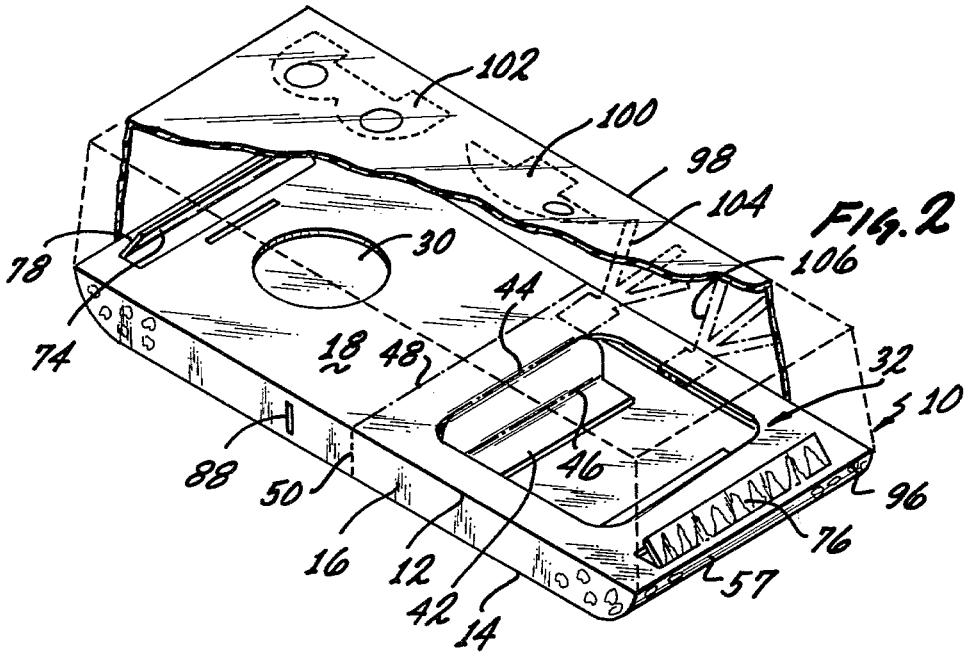
FIG. 2 is a perspective view of a fast food carry-out tray formed from the sheet material of FIG. 1.

Referring now to FIG. 2, the blank of FIG. 1 is shown folded into a fast food carrying tray by folding along lines 14, 12, 22, 24, 58, 60, 82, 94 and 96 to achieve the generally oblong shape shown. The tray cavity may be seen inside the aperature 30 as defined by the top panel 18, the bottom panel 20, and the side portions 16, 26. The hinge line 48 may be seen to approximately bisect the oblong carrying tray and extend generally perpendicular to the length of the tray.

Also shown in FIG. 2 is a lid or cover 98, which is generally oblong or trapezoidal and may be conveniently formed from a single sheet of folded sheet material in a conventional manner. The cover 98 is provided with a plurality of decorative elements 100, 102, 104, 106, defined by perforated lines so that they may be readily cut or punched out from the cover 98.

The tray is formed prior to use by folding along lines 22 and 14 and gluing the side retaining tab 54 to the end portion 56 of the bottom panel and folding the arrangement flat for shipping. After shipping, the tray is completed by folding lines 12 and 24 and inserting the end tabs 62 into the slots 72.

Figure 3:
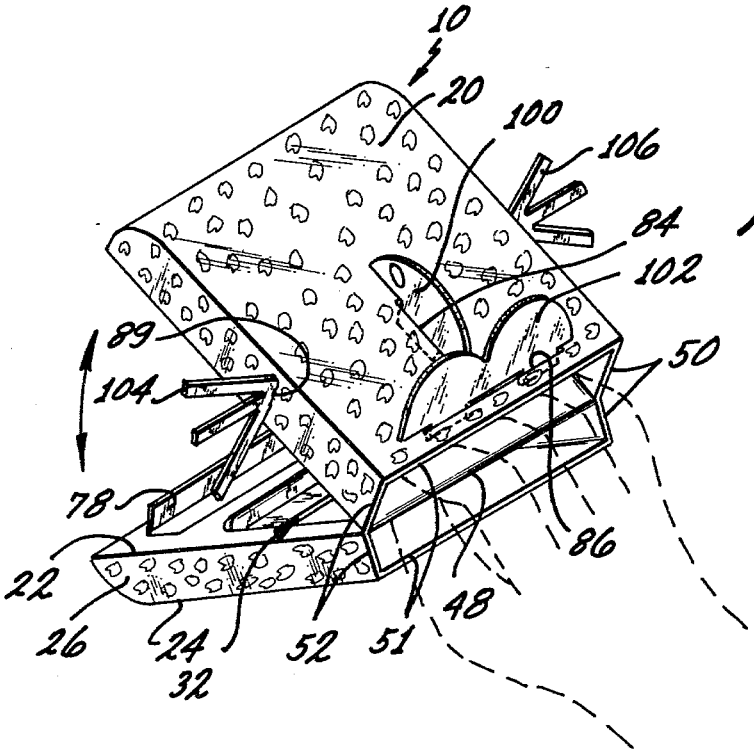
FIG. 3 is a perspective view of a puppet configuration formed from the tray of FIG. 2.

As shown in FIG. 3, the decorative elements 100–106 may be inserted into the present article when the article is folded into the puppet configuration as shown. The decorative elements 100, 102 stand up from the bottom panel 20 as they are inserted into slots 84, 86. Slots 88, 89 in the side portions 16, 26 are also used to receive decorative elements 104, 106 punched from the cover 98.

As illustrated in FIG. 3, the decorative elements have the appearance of eyes, nose, and whiskers protruding from a head portion suggested by the folded carrying tray, the jaws meeting along the hinge line.

Further realism is obtained by decorative printing on the sheet material which may be used to suggest a variety of different animals, creatures, or the like. Teeth 78 are moved into extended position by folding outwardly from the top panel 18. The foregoing provides a puppet with more play value in that more fanciful and imaginative aspects are present to afford a more realistic puppet effect.

The puppet configuration is obtained by cutting along lines 50 and 52 and folding along hinge line 48. As shown in FIG. 3, a puppeteer's hand may be received into the tray cavity with the fingers on one side of the hinge line 48 and a thumb on the other side of the hinge line 48 so that a mouth-like arrangement is formed and the mouth can be opened and closed by opposing movements of the fingers and thumb.

While the foregoing has been described with reference to a particular and presently preferred embodiment, numerous variations are contemplated within the scope of the present invention. For example, the side portions 26, 16 need not extend continuously along the lines of the article. The top panel 18 and bottom panel 20 may also be provided with a variety of apertures and openings. Other decorative elements may be formed in a pop-up manner similar to teeth 76.

What is claimed is:

1. A generally rectangular sheet of self-supporting material for forming, in a folded condition, a carrying tray convertible into a hand puppet, comprising:

at least one opening in said sheet for receiving a food item;

a first pair of parallel fold lines extending along a length of said sheet to form a first tray side portion flanked on one side by one edge of a top panel and on the other side by one edge of a bottom panel;

a second pair of parallel fold lines extending along a length of said sheet adjacent the other edge of said top panel to form a second tray side portion for cooperating with said first tray side portion in said folded condition to space apart said top panel from said bottom panel to form a tray cavity, each end of said first and second tray side portions being provided with an arcuate surface;

a hinge line extending across one of said panels, said hinge line substantially bisecting said one of said panels;

a perforated tear line provided on said sheet in colinear relationship with said hinge line and extending continuously from said hinge line to opposite edges of said sheet, whereby said hand puppet may be provided by separating said tray along said tear line and folding said tray about said hinge line;

cut lines in one of said panels and in at least one of said tray side portions for receiving decorative elements extending from said panels and said side portions;

a side retaining tab extending from one of said second pair of parallel fold lines, said side retaining tab being adapted to be engaged under the other edge of said bottom panel to secure said sheet in said folded condition;

a transverse fold line extending across the width of each panel adjacent each end thereof, a first end of each of said arcuate surfaces on said first tray side portion abutting an associated one of the transverse fold lines on said top panel and a second end of each of said arcuate surfaces on said first tray side portion abutting an associated one of the transverse fold lines on said bottom panel;

an end wall extending from each of said transverse fold lines;

a retaining slot provided in each of the end walls on one of said panels;

a retaining tab extending from each of the end walls on the other of said panels, each of said retaining tabs being provided with arcuate hook portions for retaining receipt by an associated one of said slots for closing the ends of said carrying tray when said sheet is in said folded condition; and a set of simulated teeth provided on said top panel adjacent each of said end walls on said top panel, each set of said simulated teeth being formed by providing cut lines in said top panel, whereby each set of simulated teeth may be folded to a position approximately normal to the surface of said top panel.

2. In combination with a unitary paperboard food tray including a top panel, a bottom panel, each of said panels having first and second end wall portions, a pair of side portions connecting said top panel to said bottom panel in spaced relation therewith, a crease-scored hinge extending along the minor axis of one of said panels intermediate its end wall portions, a perforated tear line provided in the other of said panels and each of said side portions, said tear line being colinear with said hinge, whereby a hand puppet may be provided by separating said tray along said tear line and folding said tray about said hinge for bringing the first and second end wall portions of said one of said panels into overlying relationship, the improvement which comprises:

a set of simulated teeth provided on said one of said panels adjacent each of said first and second end wall portions of said one of said panels, each set of said simulated teeth being formed by providing cut lines in said one of said panels, whereby each set of said simulated teeth may be folded to a position approximately normal to the surface of said one of said panels.

3. A combination as recited in claim 2, including:

a retaining tab provided on each of one of said first and second end wall portions, each of said retaining tabs including a pair of arcuate hook portions; and a retaining slot provided in each of the other of said first and second end wall portions, whereby said end wall portions of said top panel may be closed upon said end wall portions of said bottom panel by engaging each pair of said arcuate hook portions in an associated one of said retaining slots.

4. A combination as recited in claim 3 including:

an arcuate surface provided on each end of each of said side portions, whereby said first and second end walls will present sloping surfaces when they are closed upon each other.

* * * * *